United States Patent [19]

Stehlin

[11] 3,974,727

[45] Aug. 17, 1976

[54] ROTARY KNIFE, ASSEMBLY AND MACHINE FOR PROCESSING A PRODUCT

[75] Inventor: Hubert Stehlin, Caluire, France

[73] Assignee: S.A. Martin, Saint-Priest, France

[22] Filed: Apr. 22, 1975

[21] Appl. No.: 570,496

[30] Foreign Application Priority Data

June 12, 1974 France ..... 74.20284

[52] U.S. Cl. ..... 83/174; 83/506; 83/676

[51] Int. Cl.[2] ..... B26D 1/22

[58] Field of Search ..... 83/174, 506, 676

[56] References Cited

UNITED STATES PATENTS

| | | | |
|---|---|---|---|
| 1,998,929 | 4/1935 | Johnstone | 83/506 X |
| 3,055,249 | 9/1962 | Lord | 83/676 X |
| 3,465,631 | 9/1969 | Reeder, Jr. | 83/676 X |
| 3,682,032 | 8/1972 | Pfeiffer | 83/174 X |

*Primary Examiner*—Frank T. Yost

*Attorney, Agent, or Firm*—Haseltine, Lake & Waters

[57] ABSTRACT

A rotary self-sharpening knife comprises two identical half-knives each having a cutting edge on one face, the half knives being arranged with at least part of the peripheries of their other faces in contact, and means for urging the half knives together. In use the half knives are driven at different angular speeds so that there is slight relative movement of the half knives which produces a rubbing action between the peripheries of the half knives to maintain the cutting edges of the half knives sharp. The invention also relates to an assembly incorporating the inventive self-sharpening knife, and a machine for processing a product.

6 Claims, 5 Drawing Figures

ROTARY KNIFE, ASSEMBLY AND MACHINE FOR PROCESSING A PRODUCT

The present invention concerns a rotary knife for example for use in a machine for processing cardboard sheets.

In the processing of sheets of cardboard, and particularly of corrugated cardboard, for the production of blanks for packing-cases or accessories such as internal packing-pieces, the cardboard blanks are often passed through a continuously running machine having rotary tools which form cuts in the sheets in the direction of passage of the sheets through the machine. These cuts may extend completely through the sheet and constitute a longitudinal split or may only be partial cuts through the sheet without complete separation in order, for example, to enable easy accordeon-pleating of the sheet subsequently without increased thickness.

In the first case rotary knives are employed which overlap in pairs, each mounted on a different shaft, the blank passing between the two shafts. In the second case a single knife is generally employed, having a single edge and a direct cut, the cardboard passing between the knife and a rotary opposing part, arranged so that the distance between the edge of the knife and the opposing part enables the tool to pass through a more-or-less large fraction of the thickness of the cardboard sheet.

These known cutting devices have the disadvantage of very rapid wear of the cutting edges of the knives due to the high abrasive quality of the material being processed. This wear compels frequent and costly resharpening and also brings about the loss of working time of the tool as well as a significant lowering of the quality of cut.

It is an object of the present invention to provide a knife assembly which corrects these disadvantages.

According to the present invention there is provided a rotary knife for cutting a product as it is moved past the knife and while it is supported by an opposing part, comprising two identical circular half-knives of asymmetrical cross-section and having one face provided with a cutting angle and another face which is plane or slightly recessed, the half knives being arranged with their other faces in contact and maintained in contact under pressure, the two half-knives being independently rotatable and each connected to an independent driving member, wherein the respective driving members are adapted to provide the half-knives with speeds of rotation which are slightly different, the relative speed remaining low with respect to the speed of rotation of the half-knives.

The knife may be mounted in a housing which is pivotable about a shaft carried by a block and extending parallel with the axis of rotation of the knife, the block being adapted to be adjustable transversely in a machine for processing of a product. A device for vertical adjustment of the knife with respect to the block may also be provided.

The drive for the knife may include an intermediate sliding pinion carried by the block and mounted on the shaft of the housing, the sliding pinion being in constant mesh with a toothed control shaft in all transverse positions of the block.

The driving members of the half-knife may be driving pinions with a difference of one or two teeth between the two pinions, and the sliding pinion is then in two portions arranged on opposite sides of the central plane of the knife and separated by a neck into which the knife extends, each pinion portion meshing with the pinion of the corresponding half-knife.

The invention will be more fully understood from the following description of an embodiment thereof, given by way of example only, with reference to the accompanying drawings.

Figure 1:
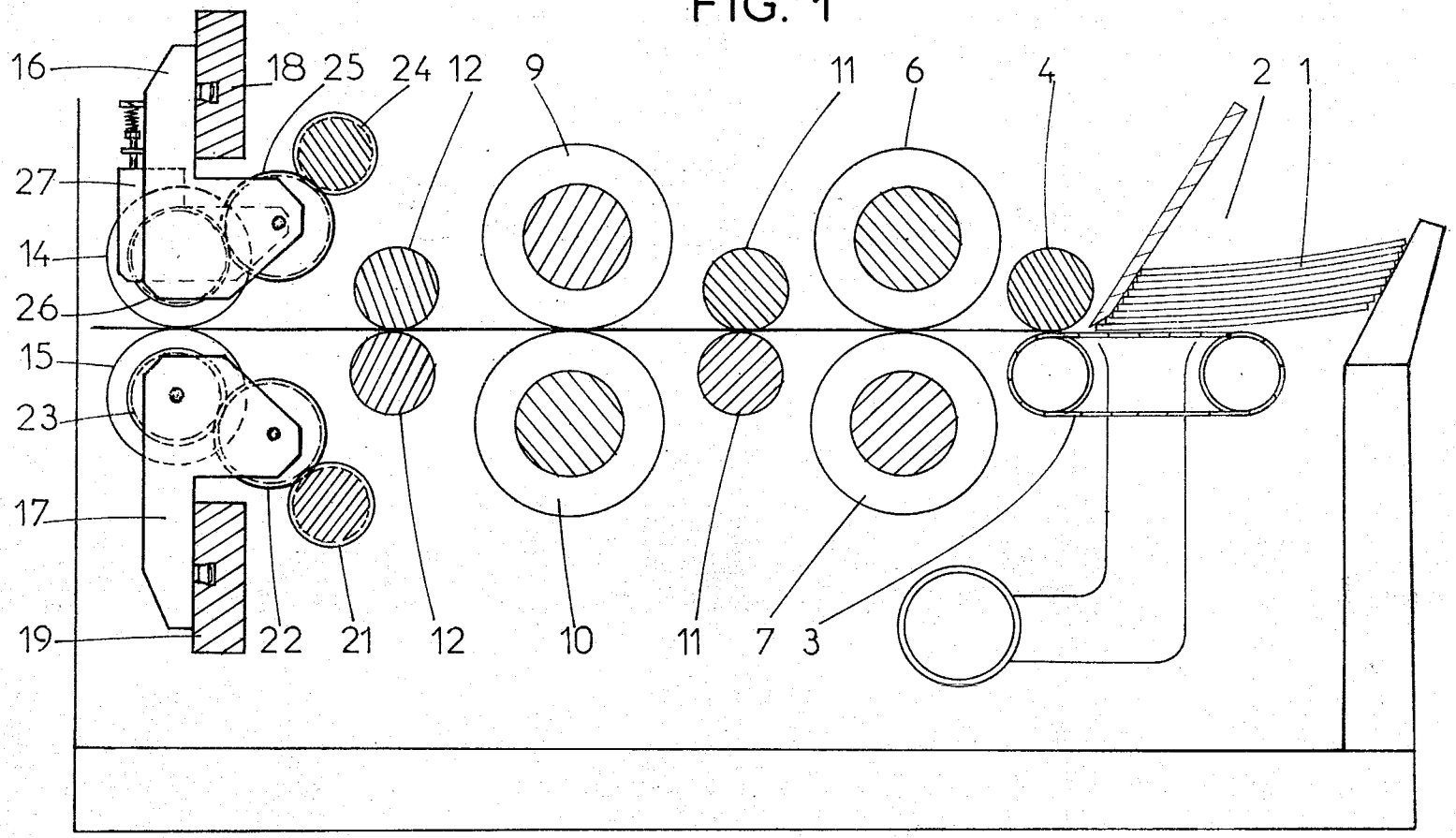
FIG. 1 is a simplified longitudinal section, showing the employment of a device through a machine for processing sheets of corrugated cardboard and including an exemplary embodiment of the present invention.

Referring to FIG. 1, there is shown a machine for processing sheets 1 of corrugated cardboard. In this machine the sheets 1 stacked in a magazine 2 are sequentially introduced one after another by driving the bottom sheet of the stack by means of a known device including a suction belt 3. The sheet, driven further forward by a drive roller 4, next passes between a first pair of cooperating tools 6, 7 where it undergoes a first compression or local crushing to mark the lines along which the sheet will have to be folded in its ultimate use. This compression is completed between similar tools 9 and 10, the sheet being supported between the compression stations by drive rollers 11. After passing between another pair of drive rollers 12, the sheet is cut longitudinally by one or more rotary knives 14 and opposing parts 15.

It will be appreciated that the compression tools 6, 7, 9 and 10 are adjustable in their transverse positions depending upon the location of the lines of fold, and similarly the or each knife 14 and its opposing part 15 are likewise adjustable in transverse position. For this purpose the or each knife 14 and the opposing part 15 are carried by movable blocks 16 and 17 respectively, which can be displaced along crossbars 18 and 19.

The opposing part 15 is driven from a side-to-side toothed shaft 21 through a sliding pinion 22 carried by the movable block 17 and meshing with a pinion 23 which is fast with the opposing part 15.

Similarly the knife 14 is driven from a toothed shaft 24 through a sliding pinion 25 carried by the movable block 16 and meshing with a pinion 26 which is integral with the knife. The knife 14 is in addition adjustable with respect to its supporting block 16 in order to adjust the depth of cut by angular adjustment of an intermediate housing 27 which is hinged about the shaft of the sliding pinion 25.

Figure 3:
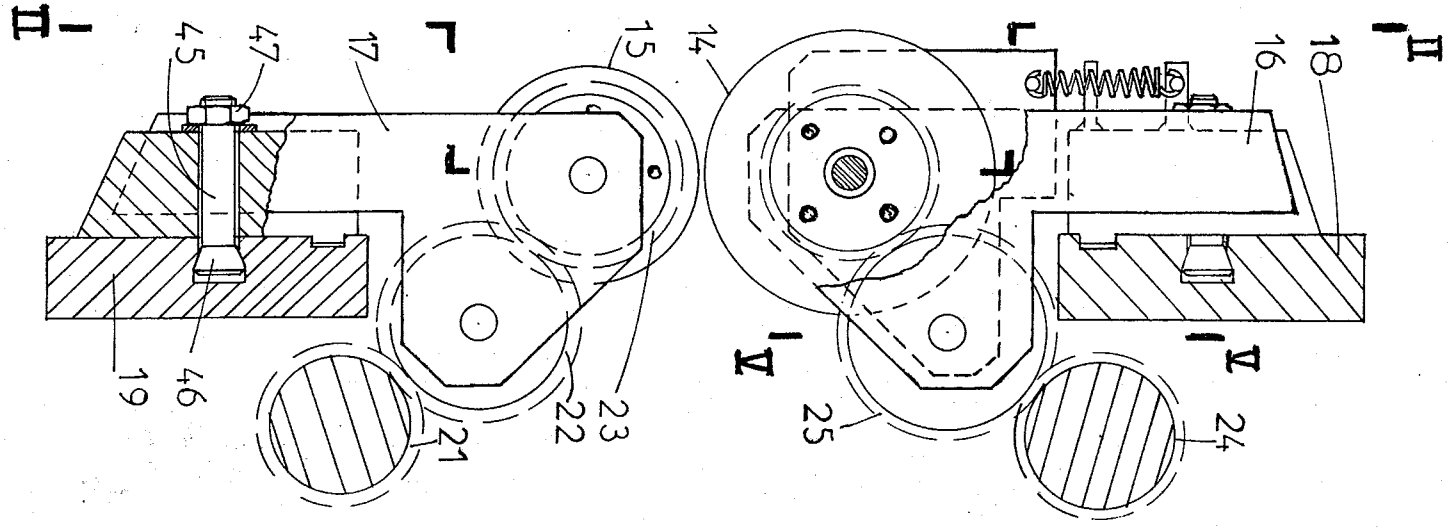
FIG. 3 is a side view of part of the machine of FIG. 1, partly in section along the line III—III in FIG. 2.
Figure 2:
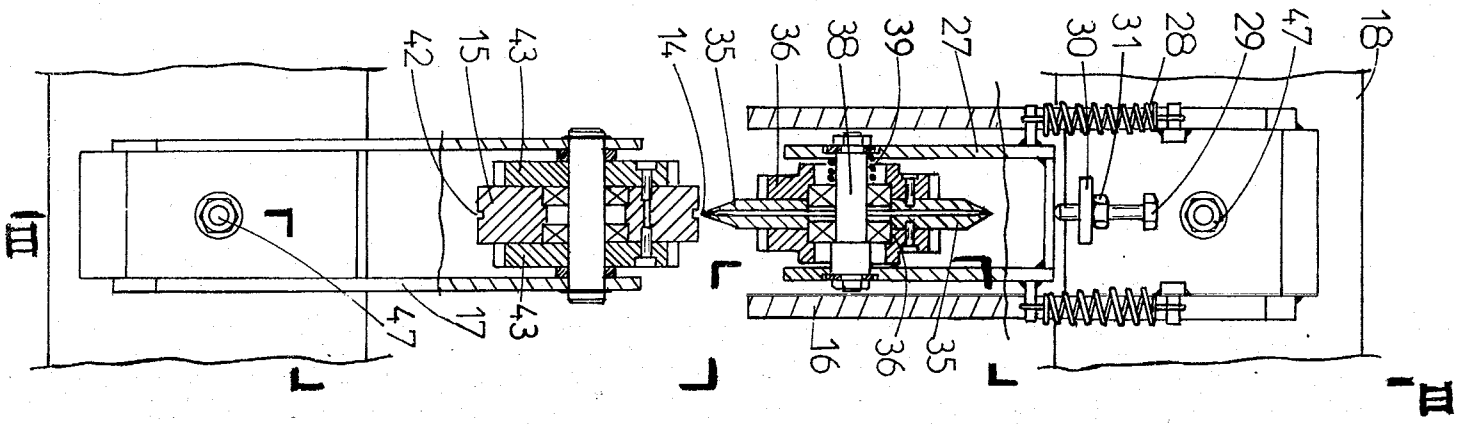
FIG. 2 is a view on a larger scale from the output end of the machine of FIG. 1 partly in section along the line II—II in FIG. 3.

The means for adjusting the depth of cut is better seen in FIGS. 2 and 3 in which the intermediate housing 27 is urged upwardly by springs 28, its definite position being determined by a stop-screw 29 which abuts the housing 27 and is engaged in a portion 30 fast with the block 16 and is locked in position by locknut 31.

Referring to FIGS. 2 to 5 it will be seen that the knife 14 in reality consists of two identical circular half-knives 35, each having a cutting angle and a slight angle of rake, placed together at their backed-off or slightly recessed faces. Each half-knife 35 is provided, on its face directed away from the other half-knife, with an external-tooth gear 36. Each knife-gear unit 35–36 is free to rotate about a shaft 38 carried by the housing 27.

Each unit 35–36 remains, however, totally independent of the other unit, the units being carried by separate bearings, and the bearing surfaces of the shaft 38 upon which each half-knife-gear unit revolves have their centres slightly offset, by about one millimetre, in the direction in which the cardboard passes through the machine.

Figure 4:
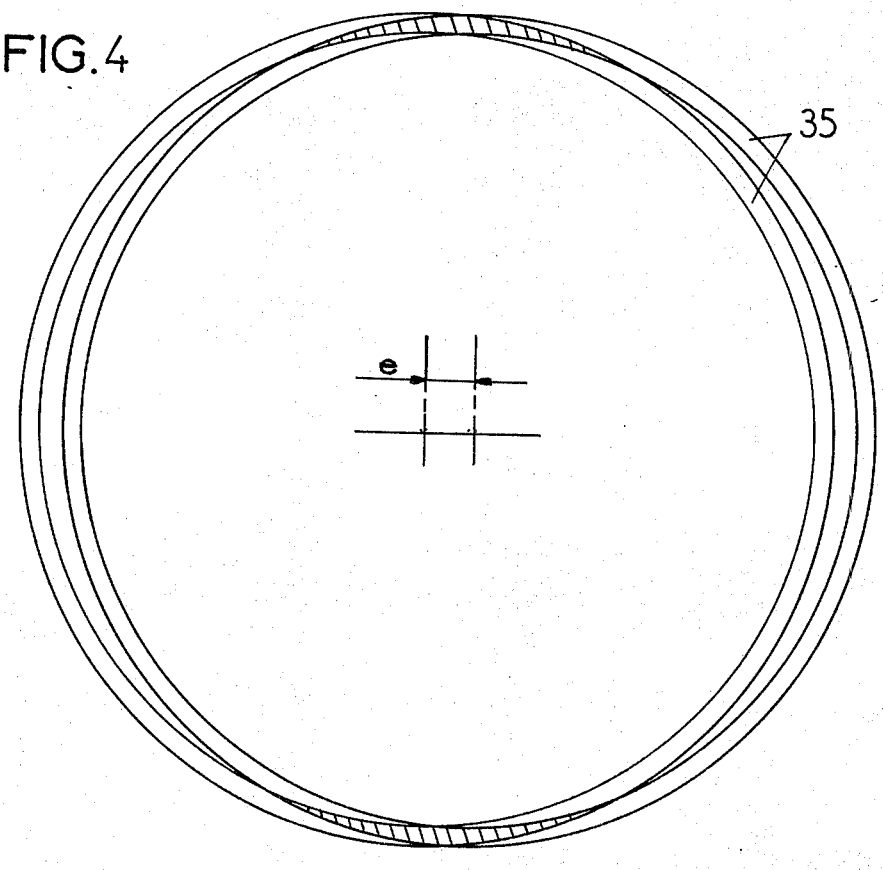
FIG. 4 illustrates in a simplified fashion the offsetting of the axes of the two half-knives and the zone of contact between these two half-knives of the knife of FIG. 1.

FIG. 4 shows, in exaggeration, the offset *e* between the centres of the two half-knives. A spring 39 keeps a slight permanent pressure between the two knives 35 which thus bear against one another along their peripheral portions.

Figure 5:
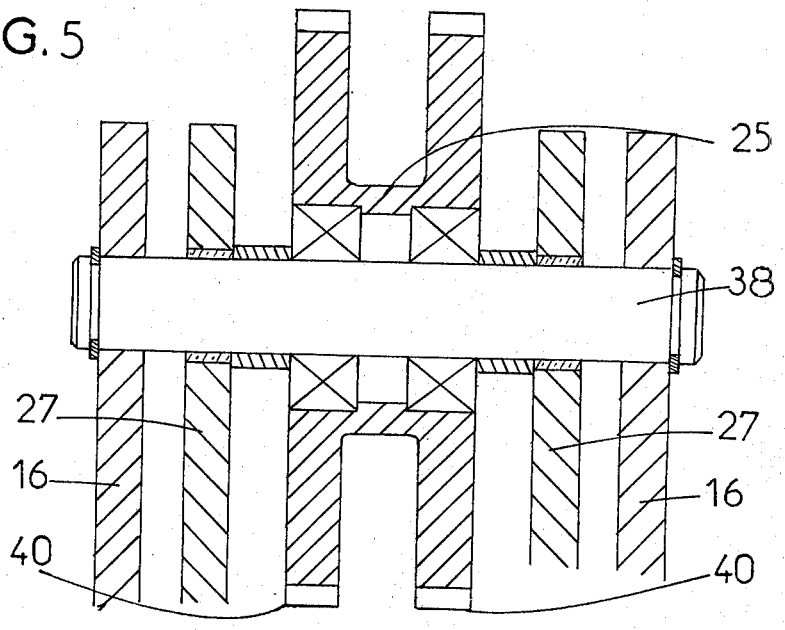
FIG. 5 is a section through the intermediate pinion for driving the knife along the line V—V in FIG. 3.

It will be observed that the two gears 36, which are each fast with one half-knife 35, constitute the pinion 26 in FIG. 1. The intermediate pinion 25 shown in greater detail in FIG. 5 is separated into two portions by a deep neck enabling the cutting-edge of the knife to pass between the portions, and each portion 40 of the pinion meshes with a gear 36. The two gears 36 which are each fast with one circular half-knife 35 have a difference of one or two teeth so that they do not revolve at the same angular velocity.

It can be seen in FIGS. 2 and 3 that the opposing part 15 associated with each knife 14 has a peripheral axial groove 42 which enables slight local flexing of the cardboard opposite the edge of the knife 14. The intermediate driving pinion 22 also has a neck enabling the solid central portion of the opposing part 15 to pass through. The pinion 23 in FIG. 1, for direct drive of the opposing portion 15 also, in fact, consists of two half-pinions 43 having the same number of teeth and meshing each with one of the two identical sets of teeth at the ends of the intermediate pinion 22.

FIGS. 2 and 3 likewise show a device for locking the knife-carrier blocks and the opposing portion-carrier blocks in their transverse positions, the locking being effected in a conventional manner by bolts 45, the heads of which engage in a groove 46 in the respective crossbar 18 or 19. Fixing in the selected position is obtained by tightening of a nut 47.

In the above described machine it will be observed that the two half-knives, because of the slight difference in the number of teeth of the two gears 36, are endowed with a relative motion which creates a sliding movement between the contacting surfaces of the knife halves which is accompanied by rubbing due to the pressure of the spring 39. This rubbing enables the cutting edges to be revived during the cutting operation. In this way self-sharpening of the knife is obtained. The area of relative rubbing of the knife halves on one another is however limited because of the slight axial offset between the centres of the two half-knives. This limited area of contact is shown shaded in FIG. 4.

It will be appreciated that the invention is not intended to be limited to the single exemplary embodiment which has been described but covers other embodiments which differ from it in detail, or in the use of equivalent means. For example the axes of the two half-knives may not be offset so that the self-sharpening is effected by rubbing over the whole of the facing peripheral areas of the two half-knives. Similarly the or each pair of the knife-halves may be driven by a motor mounted on the respective movable block so that no take-off for the motion from another shaft of the machine is required.

It will be observed that the relative motion between the two half-knives is of low value and that it does not in the least affect the possibility of giving the knife as a whole a peripheral speed which is higher than the speed at which the product is passing through the machine, as is usually practised in all cardboard-cutting machines. The cutting power of the or each knife might likewise be increased by furnishing the peripheral portion with a set of cutting teeth of the usual profile.

The invention is also applicable to machines for cutting a continuous strip longitudinally before cutting the strip transversely into sheets.

What is claimed is:

1. A rotary knife for cutting a product as it is moved past the knife and supported by an opposing part, the knife comprising: a pair of identical circular half-knives of an asymmetrical cross-section, each half-knife having one first face defining a cutting angle and an opposed second face, said half-knives being arranged with their second faces in contact; means for urging said half-knives together to maintain said second faces in contact under pressure; and independent driving members connected to each half-knife for independent rotation, said members being adapted to rotate each of said half-knives at slightly different angular speeds, such that there is relative rotation between said half-knifes, which is substantially less than either of the angular speeds.

2. The rotary knife as defined in claim 1, wherein said second faces of the half-knives are planar.

3. The rotary knife as defined in claim 1, wherein said second faces of the half-knives are slightly recessed.

4. The rotary knife as defined in claim 1, wherein the axes of rotation of said half-knives are slightly offset in a direction substantially parallel to the direction of movement of the product past the rotary knife.

5. An assembly comprising: a block; means for mounting said block in a machine for processing a product so as to be adjustable transversely thereof; a housing; a rotary knife as defined in claim 1 mounted in said housing; a shaft carried by said block and extending parallel to the axis of rotation of said knife; means for pivotally mounting said housing on said shaft; means for adjusting the vertical position of said knife relative to said block; and drive means for rotating said knife, including a pinion on said block, means for mounting said pinion on said shaft so as to engage said driving members of the half-knives, wherein said members include pinions having different numbers of teeth, said pinion on the block having two portions arranged on opposite sides of the central plane of said knife, and being separated by a neck into which said knife extends, each pinion portion being in mesh with a corresponding pinion of said knife.

6. A machine for processing a product, comprising: an assembly as defined in claim 5; and a toothed control shaft in mesh with said pinion on the block in all transverse positions of the latter.

* * * * *